US005357939A

United States Patent [19]

Tentler et al.

[11] Patent Number: 5,357,939

[45] Date of Patent: Oct. 25, 1994

[54] BOW STRING RELEASE WITH CONTINUOUS LOOP WRIST STRAP AND REVERSIBLE TRIGGER MECHANISM

[75] Inventors: Lynn A. Tentler, Fond du Lac; Louis R. Linsmeyer, Hustisford, both of Wis.

[73] Assignee: Tru-Fire Corporation, N. Fond du Lac, Wis.

[21] Appl. No.: 979,106

[22] Filed: Nov. 20, 1992

[51] Int. Cl.[5] ..... F41B 5/18

[52] U.S. Cl. ..... 124/35.2

[58] Field of Search ..... 124/35.2

[56] References Cited

U.S. PATENT DOCUMENTS

| | | | |
|---|---|---|---|
| 2,488,597 | 11/1949 | Konold | 124/35.2 |
| 2,819,707 | 1/1958 | Kayfes et al. | 124/35.2 |
| 3,948,243 | 4/1976 | Gazzara | 124/35.2 |
| 4,036,204 | 7/1977 | Scott | 124/35.2 |
| 4,282,851 | 8/1981 | Lyons | 124/35.2 |
| 4,407,260 | 10/1983 | Lyons | 124/35.2 |
| 4,527,536 | 7/1985 | Smith | 124/35.2 |
| 4,791,908 | 12/1988 | Pellis | 124/35.2 |
| 5,170,771 | 12/1992 | Peck | 124/35.2 |

*Primary Examiner*—Randolph A. Reese
*Assistant Examiner*—John Ricci
*Attorney, Agent, or Firm*—Robert C. Curfiss

[57] ABSTRACT

The bow string release includes a trigger mechanism which may be selectively operated in a push to fire or pull to fire manner. The release includes a strap mechanism having a continuous loop wrist strap facilitating quick attachment and detachment of the strap to the wrist. The distance between the release and the strap is adjustable to permit adaptation of the release and strap to varying size hands. The sear mechanism in the release is adapted to pivot relative to the release body without the use of spherical bearing elements. The pull force of the trigger is adjustable in a direction orthoganal to the trigger travel. The head of the release is both rotatable and tiltable relative to the strap.

24 Claims, 3 Drawing Sheets

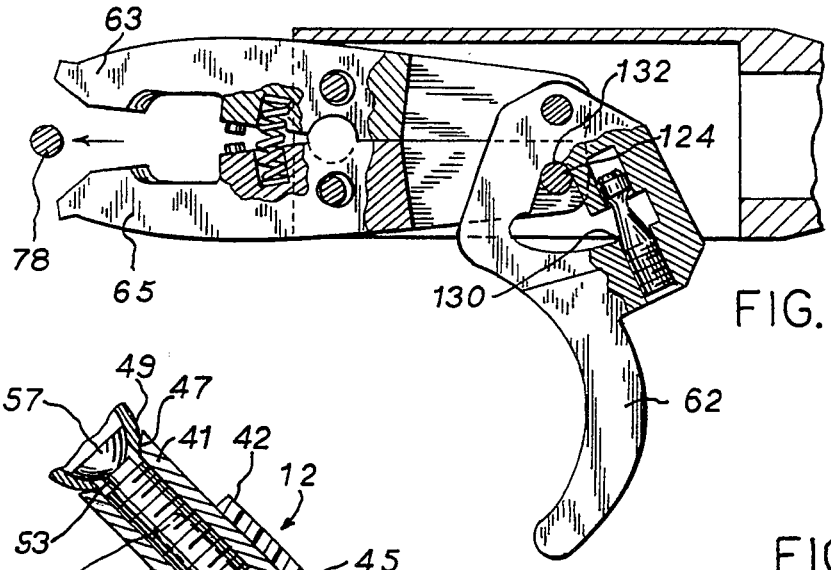
FIG. 7
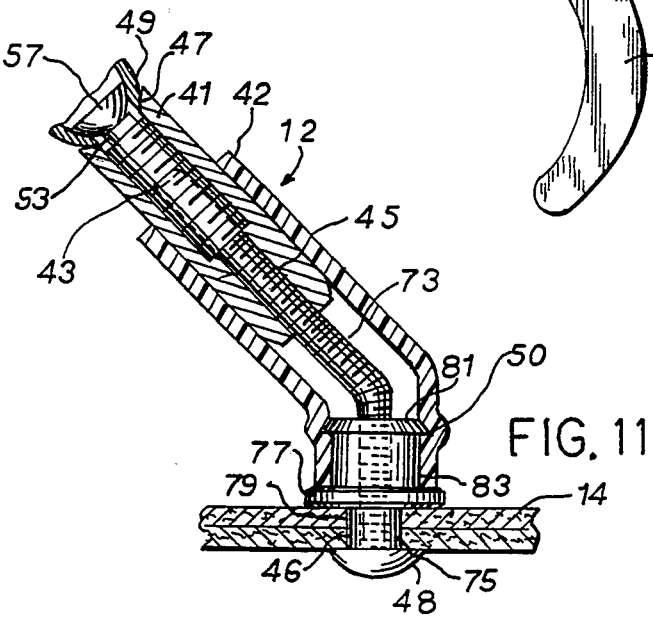
FIG. 11
FIG. 8
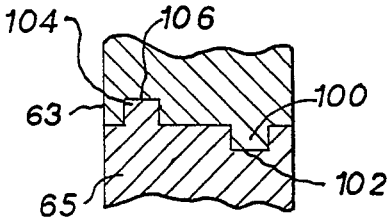
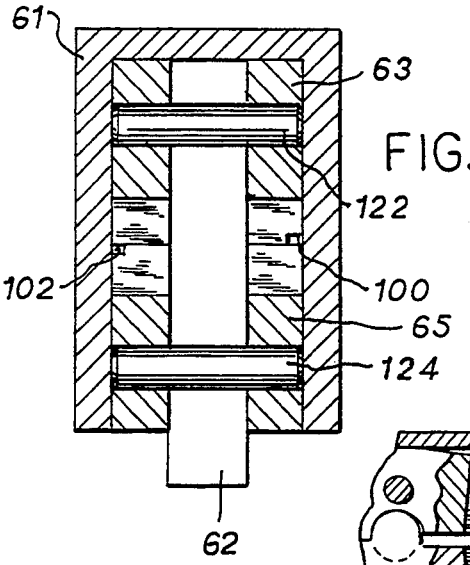
FIG. 10
FIG. 9
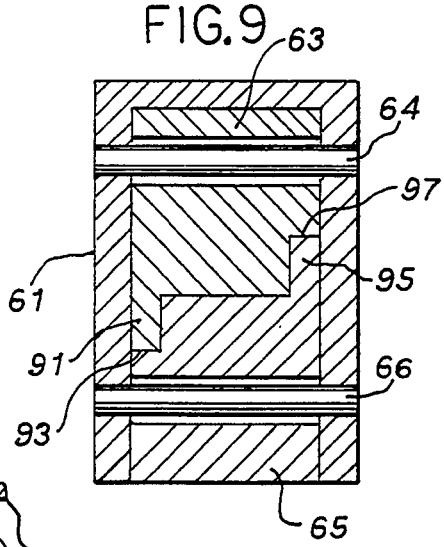
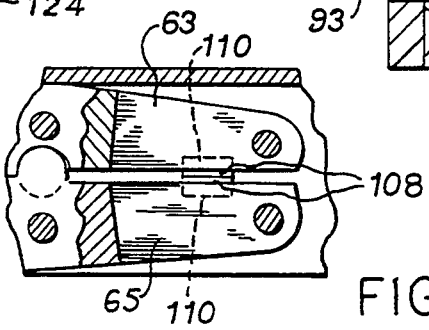
FIG. 12

BOW STRING RELEASE WITH CONTINUOUS LOOP WRIST STRAP AND REVERSIBLE TRIGGER MECHANISM

BACKGROUND OF INVENTION

1. Field of Invention

The invention is generally related to bow string releases and is specifically directed to a release having a reversible trigger and a continuous loop wrist strap.

2. Description of the Prior Art

Bow string releases are well known in the industry. Typically, a bow string release is designed to engage and lock a bow string in a mechanical sear for allowing the archer to pull the bow to its maximum draw. A trigger mechanism is then used to unlock the sear mechanism and release the string to fire the arrow.

There are numerous sear mechanisms available ranging from ball type releases as shown in U.S. Pat. No. 4,403,584 entitled: Bow String Release, issued to Todd on Sep. 13, 1983, and U.S. Pat. No. 4,476,845 entitled: Archery Bowstring Releasing Device, issued to Rickard on Oct. 16, 1984 to various jaw-type releases which have been available for many years. Each of the bow string release mechanisms utilizes a trigger release in order to disengage the sear or permitting the string to be released for firing the arrow.

Typically, trigger mechanisms operate in one of two configurations. The first configuration is generally defined as a thumb or forward release type trigger, wherein the bow string is held in the forefingers, with the release in the palm of the hand and the trigger mechanism facing upwardly. When the thumb is pressed forward against the trigger, the sear is opened and the jaws are released for releasing the string. In the second configuration, the trigger mechanism operates in much the same manner as a firearm trigger, with the release being held in the palm of the hand and the trigger being disposed behind the index finger, wherein the release is unlocked when the trigger is squeezed by the index finger in a rearward direction, in the same manner as firing a pistol, rifle or other firearm. The particular trigger configuration selected is primarily a matter of choice. Some archers prefer the thumb-type or forward motion trigger whereas many others prefer the firearm-type or reverse motion trigger.

To date, there are no string release mechanisms which permit the archer to select a forward or reverse motion from a single mechanism. It would be desirable to provide such a mechanism since this would permit the archer to experiment with both types of trigger mechanisms without the expense of buying a plurality of bow string releases. Also, it would greatly enhance manufacturability of the string releases, permitting a single trigger mechanism be utilized for either a forward motion or a reverse motion string release.

As is also typical, most bow string releases are secured to the wrist of the archer, permitting the release to be held in an at ready position while, freeing the fingers of the hand for other tasks. Also, by attaching the release to the archer at the wrist area, the amount of strain on the hand is greatly decreased when high draw weight bows are utilized, which is typical in archery hunting and archery tournaments. Many various straps and harnesses are available for bow string releases. An example of a widely accepted V-type strap is shown in U.S. Pat. No. 4,831,997 entitled: Wrist Strap, issued to Greene, on May 23, 1989. Another example of a V-type strap is available from Martin Archery, Inc. in Walla Walla, Washington, known as the No. R-63 Quick-Silver Release, as illustrated in Archery Business, August-/September 1988 issue. As there shown, the Quick-Silver Release includes an enlarged palm area to which the release is pivotally attached on an elongated, cylinical shaft. The strap includes two ends which extend outwardly from the palm area and are adapted to be positioned around the wrist, after which one end is placed through a buckle about the wrist in the same manner as a belt would be attached about the waist.

The Greene release works in a similar fashion, with the two ends of the strap being placed around the wrist and then attached to secure the release strap and release to the wrist of the archer.

Another typical feature included in the No. R-63 Quick-Silver Release and as shown in a number of U.S. patents issued to Paul Peck and assigned to the present assignee, is the jaw action sear for closing and opening the string retaining notches. In most cases, a bearing element is positioned between the two jaws approximately in alignment with the pivot points thereof. The bearing element assures smooth, low friction action of the jaws as they are moved from the closed to the open position, assuring a good true line for the fired arrow. Many of these releases are self-closing with the string being placed in the space between the jaws and into the notch, after which it engages a closure abutment for locking the jaw in the closed position. The jaw is then not opened for releasing the string until the trigger mechanism is activated.

While there have been many advances in the string release art over the last several years, the strap mechanisms of the prior art require development of a certain amount of skill in order to properly place both ends of the strap over the wrist and secure the strap to a fastening means such as a belt buckle or the like. Also there are known no releases with dual action reverse and forward motion triggers. Finally, the jaws have not been substantially altered over the years, with most having a narrow opening for receiving the string and relying on a bearing element between the jaws adjacent to the pivot points in order to assure smooth firing. While these jaws have been acceptable from a functional standpoint, the addition of the bearing element greatly increases the cost of manufacture.

Therefore, there remains a need to provide a smooth action jaw-type string release with a reduced cost of manufacture without sacrificing any of the functional performance requirements now demanded by archers. In addition, there remains a need for a dual action trigger, permitting the archer to fire either by pressing or releasing forward or squeezing rearward, as desired or as dictated by circumstances. It remains desirable to provide a jaw mechanism which, when opened, permits more readily loading of the string into the release notches, without sacrificing any of the locking features of the jaw or without greatly increasing the distance of travel between the opened and closed positions. In addition, it is desirable to provide a means for predictable, calibrated adjustment of the trigger force, to individual touch.

SUMMARY OF THE INVENTION

The subject invention is specifically directed to a bow string release having a new wrist strap attachment permitting a continuous, open loop to be formed, wherein the release may be secured to the wrist and positioned in the palm of the hand by sliding the hand through the loop and then cinching the strap to the desired tightened position. This greatly increase the efficiency with which the archer may place the release on his wrist. In addition, because of the ability to precisely control the circumference of the strap about the wrist, repeatability and comfort are also enhanced. The bow string release of the subject invention includes a trigger mechanism which is adapted for firing both in a forward and a reverse direction, simply as a matter of choice. Specifically, a contoured guide path such as a controlled guide slot is provided in the base of the trigger mechanism. The trigger is a center fire mechanism, wherein the center fire position may be engaged from either side, both of which define independent closed positions for retaining the string. When the trigger is pressed or released forward, it moves off a first locked idle position and releases the sear mechanism. Likewise when the trigger is pulled rearward, it releases the trigger from the second locked position and releases the sear.

The preferred embodiment of the invention includes a lock-out feature to assure that the trigger is not inadvertently moved in the wrong direction, prematurely releasing the string and potentially prematurely releasing an arrow, the guide path for the trigger mechanism is specifically designed to normally operate in the pull to release, forward to lock motion. Thus, when the trigger is pulled back for loading, it automatically stops at the center position. Then, when it is moved forward, the sear is locked. If the archer decides or prefers to squeeze or move the trigger in a rearward direction in order to lock the release for retaining the string, it is first required that he push the trigger downward from its center position to close the notches for holding the string. Thus, as he loads the string and arrow in the sear mechanism, if he does not push the trigger downward, the trigger will operate in the forward to lock motion.

If the trigger is pushed downward during the loading operation, the trigger will then only operate when squeezed rearwardly. This feature assures against release the trigger when moving from the released position to the locked positions. Of course, this press to load feature may be replaced by a guide slot similar to the forward to lock motion allowing the release to be locked without pressing, if desired.

It is another feature of the subject-invention that the jaw mechanism has been reconfigured to permit elimination of the bearing element required between the pivotal jaws of the prior art. Specifically, an integral arcuate bearing surface is provided on one of the jaws and is adapted to be received in a mated arcuate bearing recess provided in the second jaw, assuring a smooth action of the jaw without requiring a separate bearing element. Since the jaws can be manufactured as a unitary element, this greatly reduces the cost of manufacture without sacrificing quality of the release mechanism. Also, to reduce the effect of wear and tear on the jaw mechanism, a pair of unique guide pins and sockets are provided forward of the bearing surface, to assure that the jaws always close in the same position when pivoting between the open and closed positions. This also assures that the front forward surface of the string retaining notch properly closes, causing proper, smooth abutment between the two jaws, reducing wear and tear on the string and reducing relative movement between the jaws in the locked position.

Another important feature incorporated in the jaw reconfiguration of the subject-invention is the addition of a resilient pad between the jaws near the trigger mechanism end thereof. When the jaws move from the closed to the open position, they are sprung outwardly by the release of the string under tension. This causes the jaws to hit against one another, often causing an undesirable "clicking" noise. By placing a resilient, cushioning pad between the jaws near the rearward end thereof, the release mechanism of the subject invention becomes virtually noiseless.

In order to facilitate reloading of the jaw, the forward end of the jaws have been reconfigured to provide a wider opening for receiving the string. Specifically, the outer tips of the jaws have been opened to provide an enlarged "V" opening for receiving the string. When the jaws are in the open position after firing, the open outer end of the jaws are approximately double the open width of prior art jaws, greatly facilitating entry of the string for reloading.

Finally, the bow string release of the subject-invention is attached to the wrist strap in such a manner as to permit adjustment of the distance between the trigger mechanism and the strap. This is accomplished in the preferred embodiment by providing a threaded shaft extending outwardly from the rear surface of the bow string release mechanism. An elongated, internally threaded stud is secured to the strap and is adapted for receiving the threaded shaft. The stud is secured to the strap in such a manner that it may be rotated about its axis without changing its longitudinal length relative to the shaft. By rotating the stud relative to the strap, the relative axial position of the release to the strap may be altered. This provides a desirable feature not available on prior art release and strap combinations, accommodating a variety of different sized hands on either the left or right hand, without sacrificing either the position of the trigger or the position of the wrist strap. In addition, the ability to swing the release along side the archer's wrist/hand on either side permits free and clear use of that hand without removing or adjusting the position of the wrist strap.

An additional feature of the preferred embodiment is provided in the unique manner in which the trigger force adjustment for a rearward motion to release type trigger mechanism. It is to be understood that this same adjustment mechanism can also be applied to the forward to lock trigger position, where desired. In the preferred embodiment, a set screw is positioned orthogonal to the motion of trigger travel, unlike in the prior art, where such screws are generally in longitudinal alignment with trigger control mechanism. By providing a conical or tapered surface which intersects the trigger path at an oblique angle, the distance of travel may be adjusted simply by turning the screw along is axis. This has several advantages over prior art adjustment mechanisms. First, this permits adjustment of the trigger at the trigger base, permitting ready access to the adjustment mechanism in the locked position. Secondly, by placing the movement of adjustment in a position orthogonal to the direction of trigger travel, the adjustment is more permanent in that repeated use of the trigger does not have a tendency to cause the adjustment to back off or creep from repeated use. Additionally, the trigger sear members may be shaped in such a way as to provide an adjustable range where a fixed proportional change in the adjustment screw results in a directly proportional change in the trigger pull force. If so desired, these members can be shaped to provide larger adjustment changes at lower trigger pull settings for very fine control.

It is, therefore, an object and feature of the subject invention to provide for an improved bow string release mechanism having a reversible trigger and a modified and simplified wrist strap attachment.

It is another object and feature of the subject invention to provide a wrist strap having a permanent loop construction for facilitating positioning of the strap on the wrist for securing the release.

It is another object and feature of the subject invention to provide a bow string release with a trigger mechanism which is operable either in a rearward or a forward release motion.

It is a further object and feature of the subject invention to provide a reconfigured jaw construction, eliminating the need for independent bearing elements between pivotable jaw mechanisms.

It is a further object and feature of the subject invention to provide a separate, tighter jaw locking means to reduce relative jaw movement, protecting against string wear and premature fire at low trigger force settings.

It is yet another object and feature of the subject invention to provide an improved jaw tip, facilitating entry of the string into the string retaining notches during reloading.

It is also an object and feature of the subject invention to provide a bow string release attached to a wrist strap, wherein the position of the release relative to the strap is adjustable for accommodating varying size hands without sacrificing the position of the trigger or the position of the strap around the wrist, with a contoured edge to both fit into the palm of the hand and provide an edge adapted for gripping when pulling the bow string back.

It is also an object and feature of the subject invention to provide means for adjusting the trigger, to adjust the amount of force to operate the trigger.

Other objects and features of the invention will be readily apparent from the accompanying drawings and detailed description.

BRIEF DESCRIPTION OF THE DRAWINGS

FIG. 7 is similar to FIG. 5, and shows the release as opened after fire from the cocked position of FIG. 6.

FIG. 8 is a sectional view taken along the line 8—8 of FIG. 4.

FIG. 9 is a sectional view taken along the line 9—9 of FIG. 4.

FIG. 10 is a sectional view taken along the line 10—10 of FIG. 4

FIG. 11 illustrates the attachment of the coupler shaft to the base of the wrist strap assembly of the subject invention.

FIG. 12 shows the position of the resilient pads for silencing the firing mechanism of the release of the subject invention.

DETAILED DESCRIPTION OF THE PREFERRED EMBODIMENT

Figure 1:
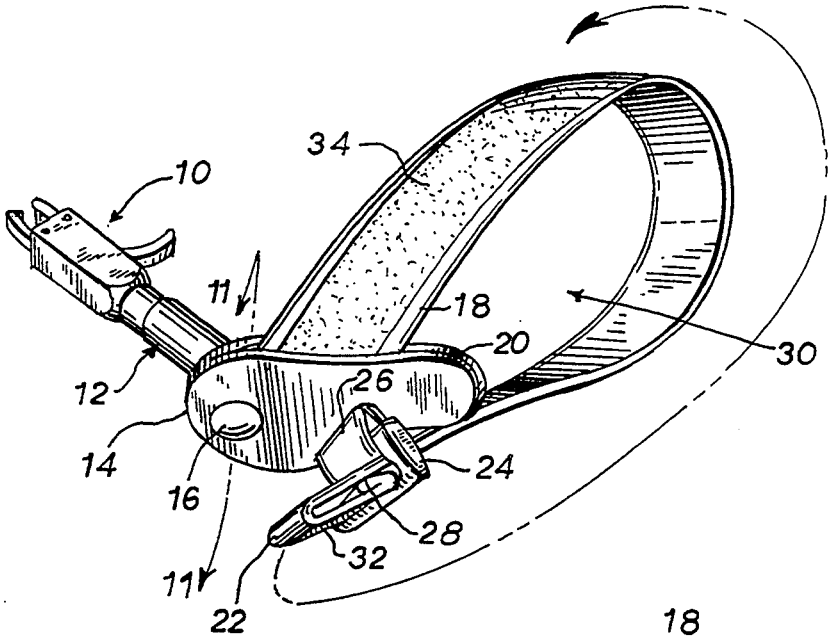
FIG. 1 is a perspective view of a bow string release and wrist strap combination in accordance with the subject invention.

As shown in FIG. 1, the wrist strap and release combination of the subject invention includes a release mechanism 10 secured to a rotatable shaft 12 which is in turn secured to the base 14 of a wrist strap, as depicted by the fastener 16. The wrist strap base 14 includes as an elongated pad having a strap member 18 extending outwardly from the upper edge 20 and looping around behind the base 14, with an outer end 22 as shown in FIG. 1. A buckle 24 or other fastener means is secured to the base 14 via a loop 26. It will be readily understood by those who are skilled in the art that other means for securing the strap 18 and the buckle 24 to the base 14 could be utilized without departing from the scope and spirit of the invention.

Figure 2:
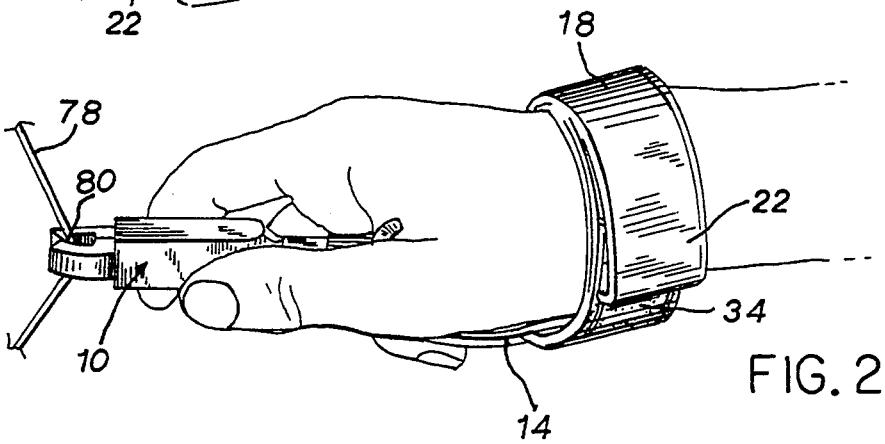
FIG. 2 is an illustration of the release of FIG. 1 as attached to the wrist of an archer and with the release in the firing position.

In the preferred embodiment, the buckle 24 has a center post (not shown) for creating a rectangular opening 26 adapted for receiving the strap 18. The outer end 22 of the strap 18 is folded back over itself and stitched or otherwise secured as shown at 28 to assure that the outer end 22 of the strap cannot readily pass back through the buckle 24 after it has been inserted therethrough. This provides a continuous open loop 30, as clearly shown in FIG. 1. In order to place the wrist strap on the hand of the archer as shown in FIG. 2, the archer simply slips his fingers and hand through the loop 30, and grasps the release 10 as shown in FIG. 2, with the base 14 of the strap properly positioned in the back of the hand, beneath the thumb and wrist area. The outer strap 18 then is positioned behind the thumb, where it encircles the wrist. By grasping the outer end 22 of the strap 18, and pulling it through the buckle 24, the strap is tightened about the wrist. In the preferred embodiment, the outer end 22 of the strap includes a fastener pad 32 such as a Velcro or other hook and loop type fastener. The outer surface of the strap 18 includes a complementary fastener pad or strip 34 which is adapted for receiving and securing the fastener pad 32 in any of an infinite variety of positions, for securely tightening the strap 18 about the wrist, as shown in FIG. 2.

Figure 3:
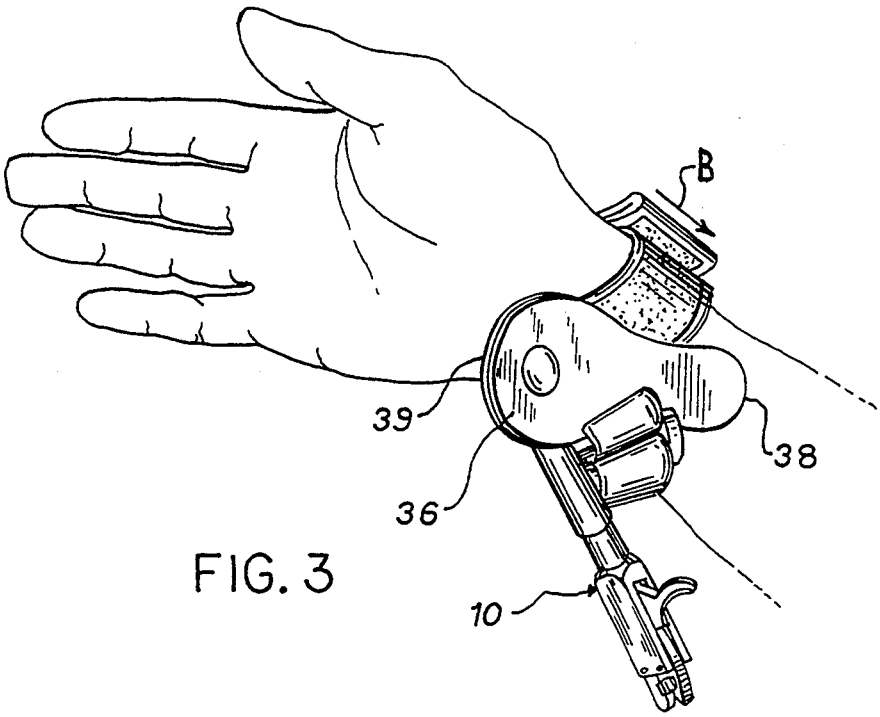
FIG. 3 is a view of the release and wrist strap combination as attached to the wrist of the user, with the release in an at rest position.

As is best shown in FIG. 3, the base 14 of the strap member is of a "tear drop" shape, having a wide front portion providing a contoured front edge 39 to grip when pulling the bow and for securely holding the release 10, and a narrowing rear portion 38 shaped to fit the palm of the hand for permitting better flexing of the thumb and palm and wrist once the release has been secured to the hand. Additionally, the "tear drop" shape holds the release up in easy reach when not in a quick access position.

As is best shown in FIG. 11, the shaft assembly 12 includes an adjusting sleeve 41. The adjusting sleeve 41 has a large threaded central bore 43 at one end thereof and a small threaded central bore 45 at the opposite end thereof. The outer end 47 of the large threaded bore 43 includes a radius for receiving the convex end 49 of the body of the release (See FIG. 4). The adjusting sleeve 41 is secured to the body via a screw or pin member 53 which, in the preferred embodiment, is a swivel screw having a threaded shaft 55 and a convex head 57. The convex head 57 is adapted to be received in an arcuate socket 59 provided in the body of the release.

The arcs defining the convex head 57, the socket 59, the convex end 49 and the radial arc end 47 of the adjusting sleeve are in concentric and axial alignment with one another, respectively, permitting the release body 10 to tilt relative to the axis of the adjusting sleeve 41, permitting further fine adjustment of the position of the string release 10 relative to the shaft assembly 12 and the strap assembly 14. Thus, the strap assembly for securing the release 10 to the wrist permits both rotational and tilting adjustment of the release relative to the strap.

It will be noted that the swivel screw 53 includes a hollow, central clearance bore 71 (FIG. 4) adapted for receiving the adjusting rod 73. The adjusting rod 73 passes through the clearance bore 71 of the screw and through the large bore 43 of the adjusting sleeve and is threadibly received in the small threaded bore 45 of the sleeve (FIG. 11). The one end of the adjusting rod extends beyond the end of the adjusting sleeve 41 and is secured in a swing adapter member 50.

The swing adapter member 50 includes a lower end comprising a cylindrical shaft 75 and a central base enlarged circular flat base 77. The shaft 75 is adapted to pass through the clearance hole 46 provided in both layers of the base pad 14 of the string release. A headed screw 48 is then threadably received in the threaded central bore 79 of the swivel adapter for sandwiching the base 14 between the head and the swing adapter base 77.

The upper end of the swing adapter 50 includes an enlarged cylindrical shaft 83 with a protruding, tapered lip or barb 81 at its outer end. The extended end of the adjusting rod 73 is threadably received in the bore 79 of the swing adapter and is tightened therein for securely holding the adjusting rod relative to the base 14 of the strap.

In order to alter the position of the release 10 relative to the strap base 14, the adjusting sleeve 41 is rotated to axially advance or retract it along the adjusting rod 73. The release 10 moves in unison with the adjusting sleeve 41 since it is secured thereto via the swivel screw 53.

In order to assure against incidental rotation of the adjusting sleeve 41 relative to the adjusting rod 73, a resilient, tight fitting outer sleeve 42 is secured to the adjusting sleeve as shown in FIG. 11 and extends downwardly over the enlarged shaft portion 83 of the swing adapter 50. The outer barb 81 of the swing adapter 50 stretches and tightly grips the resilient sleeve 42, assuring against incidental rotation of the adjusting sleeve relative to the adjusting rod and the swing adapter.

As can be seen in FIG. 3, by utilizing the assembly as previously described for securing the shaft 12 to the strap base 14, the entire release 10 and shaft assembly 12 can be pivoted downwardly or upwardly out of the firing position, moving the release to a position along side the wrist and hand on either side and releasing the hand for other functions without removing the strap 18 from the wrist. As also can be seen by FIG. 3, where desired the wrist strap can be retracted slightly away from the wrist in the direction of arrow B without removing the wrist strap from the archers wrist and hand area. This greatly facilitates use of the hand while keeping the release mechanism in an at ready position.

Turning now to the release mechanism, per se, the preferred embodiment of the release mechanism is specifically shown in FIGS. 4–10, with the resilient silencing feature shown in FIG. 12. With specific reference to FIG. 4, the release mechanism 10 includes a body 61 for housing a sear mechanism comprising a pair of jaws 63 and 65 controlled by the actuator trigger mechanism 62. In the preferred embodiment, both jaws 63 and 65 are mounted for pivotal movement relative to the housing at pivot points 64 and 66, respectfully. However, it will be readily understood that the jaw mechanism and trigger mechanism of the subject invention could be adapted to a single pivotal jaw configuration without departing from the scope and spirit of the subject invention.

In the preferred embodiment, each jaw comprises an elongated member having an outer tip 70 which projects outwardly from the forward open end 72 of the body 61. Approximately mid-way between the outer end 70 and the inner or rearward end 72 or each jaw is a pivot point, upon which each jaw is mounted on a pivot pin 64, 66 provided in the body 61. Slightly rearwardly of the outer tip end 70 of each jaw is a string retaining notch 74. When the jaws are in the closed position shown in FIGS. 4 and 6, the radial front surface 76 of each notch 74 is configured to conform to the periphery of the bow string 78. As is particularly shown in FIG. 4, the surface 80 of each jaw is also convex contoured to accommodate the position of the string when the bow is at maximum pull as shown in FIG. 2. This assures that no portion of the bow string is engaged by a sharp corner or sharp surface when the release of the subject invention is utilized.

It is an important feature of the subject invention that the outer tip 70 of each jaw has been modified to include a tapered surface 84 providing a wide "V" opening 86 in the jaw mechanism. The wide "V" opening 86 presents a substantially wider mouth, as particularly shown in FIGS. 5 and 7, greatly facilitating replacement of the bow string 78 in the sear mechanism when reloading, without compromising the shape of the string retaining notches 74 or the contours 76 and 80 of the forward surface of each notch.

Figure 4:
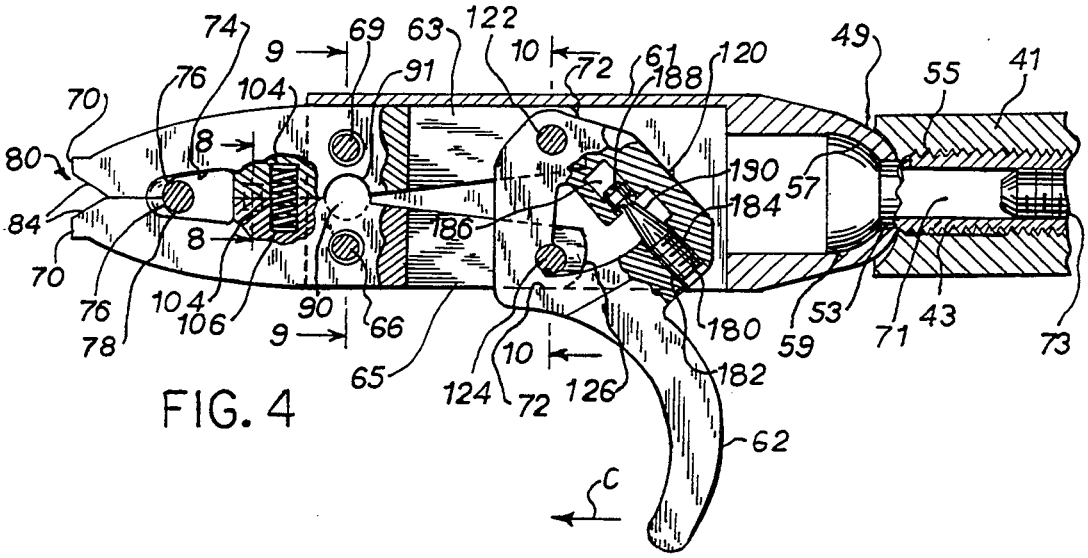
FIG. 4 is a longitudinal sectional view of the release of FIG. 1, showing the trigger mechanism cocked for a forward fire operation.
Figure 5:
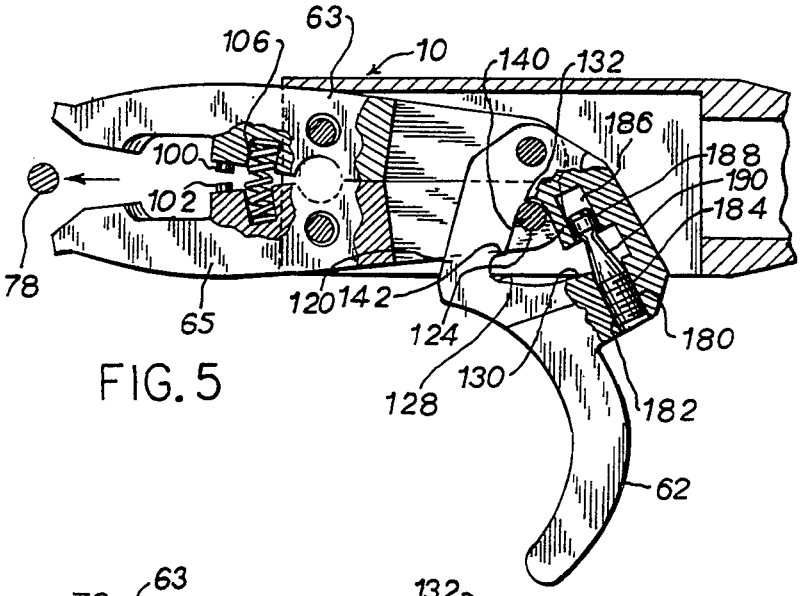
FIG. 5 is a view similar to FIG. 4, showing the release as fired from the position of FIG. 4, opening the sear mechanisms for releasing the bow string.

It is also an important feature of the subject invention that the heretofore required independent bearing element has been eliminated. In the preferred embodiment of the subject invention, an integral arcuate tab 91 is provided on one of the jaws 63. A recessed, mated arcuate bearing seat 93 is provided on the mated complimentary jaw 65. As is best shown in FIG. 9, the tab 91 extends outwardly from the jaw 63 and is received in the mated seat 93 provided in the jaw 65. As is shown in FIGS. 4 and 5, the outer surface of the tab and the seat arcuate for providing a sliding bearing surface permitting the jaw to pivot open and closed. In the preferred embodiment a second tab 95 is provided on the bottom surface of the jaw 65 and extends outwardly and is received in a mated arcuate seat 97 provided in the jaw 63. The tabs 91 and 95 and seats 93 and 97 eliminate the need for the separate spherical bearing element used in many prior art configurations. In addition, the dual tab mechanism of the subject invention actually enhances the working function of the jaw by assuring that the jaws are locked in relative spacial relationship as they pivot, further assuring proper seating of the notches 74 as they retain the string and also providing a tighter fit while at the same time reducing dependence on machining and manufacturing tolerances.

To further assure proper opening and closing action of the jaws, the subject invention includes a unique nesting pin arrangement, as is best shown in FIGS. 4 and 8. As there shown, the forward end of the jaws 63 and 65, between the pivot points 64, 66 and the string retaining notches 74, includes a unique pin and socket arrangement for seating or nesting the jaws when they are in their closed position. As is specifically shown in FIG. 8, the jaw 63 includes an outwardly projecting pin 100 which is received in a mated socket 102.

Likewise, the jaw 65 includes an outwardly projecting pin 104 which is received in the mated socket 106. This assures proper seating of the jaws when they are moved into the closed position, and accommodates for any wear and tear on the jaw mechanism from repeated use, which, due to relative movement between the jaws, can prematurely open the release. This further results in enhancing the life of the bow string release mechanism. This results in further assuring that the forward ends 76 of the string retaining notch are properly aligned to reduce wear and tear on the bow string 78.

As is typical in jaw type releases, a seat 104 is provided in each jaw for receiving a compression member such as the spring 106, for normally biasing the release mechanism into the open position of FIGS. 5 and 7.

In order to minimize the noise created by the rapidly opening jaws 63 and 65 when they are sprung open by the tension on the bow string 78 as the trigger 62 is released, a resilient cushion or member may be placed between the rear end of the jaws to prevent their abutting contact when the release is opened through firing. In the preferred embodiment, a pair of resilient cushions 108 may be inserted in each jaw in a receptive seat 110, as clearly shown in FIG. 12. Thus, as the jaws spring open, the two rearward ends 72 and 73 of the respective jaws 63 and 65 are kept in a spaced apart relationship by the presence of the cushions 108. The provision of the cushions 108 provide a release mechanism with a silent firing mechanism, eliminating the clicking noise associated with many jaw type releases.

It is an important feature of the subject invention that the trigger mechanism 62 is operable in both a forward and reverse motion. As is specifically shown in FIGS. 4 and 5, the trigger mechanism 62 may be locked in a closed position for retaining the string 78, by pulling the trigger rearward, as shown in FIG. 4 and releasing it forward in the motion of arrow C, as shown in FIGS. 4 and 5. Specifically, the trigger 62 includes a base member 120 which is pivotally mounted on one of the jaws 63 as shown at 122. The second jaw 65 includes a guide post 124 which is adapted to be received in a contoured guide path or slot 126. In the preferred embodiment, the slot is generally "T" shaped with a forward extending outer reach 128 and a rearwardly extending outer reach 130, as is best shown in FIGS. 5 and 7. The base 132 of the "T" extends from the outer reaches 128 and 130 toward the pivot point 122. In the preferred embodiment, the base of the guide path 126 is tapered and is wider at the junction with the outer reaches than it is at its inner tip, for producing a smooth acting trigger motion.

As is specifically shown in FIGS. 5 and 7, the sear mechanism is opened for spreading the notches 74 when the guide pin 124 is positioned at the base 132 of the guide slot. When a string is positioned in the notches 74 of the opened release shown in FIG. 5, the trigger may then be pulled rearwardly, forcing the guide pin 124 to ride along the surface 140 of the base 132 and into the outer reach 128 of the slot, as shown in FIG. 4, for locking the string 78 in the closed notches 74. Upon forward motion of the trigger 62 in the direction of the arrow C (FIG. 4), the base 120 of the trigger is moved so that the guide pin 124 passes over the path junction 142 between the outer reach 128 and the base 132, permitting the guide pin to slide back down the surface 140 of the guide path, causing the notches 74 to spread apart for releasing the string 78. In the preferred embodiment surface 140 is not a ramp so to force consience selection to engage the trigger in the locked position of FIG. 4. It is, therefore, necessary to push down (toward pivot 122) on the trigger, forcing jaw 63 toward the wall of the body 61, and permitting the guide pin 124 to move over the corner 142 of the guide path. This permits the guide pin to slide into the forwardly extending outer reach 128 of the guide slot 126, permitting the jaws to close in the manner shown in FIG. 5.

Figure 6:
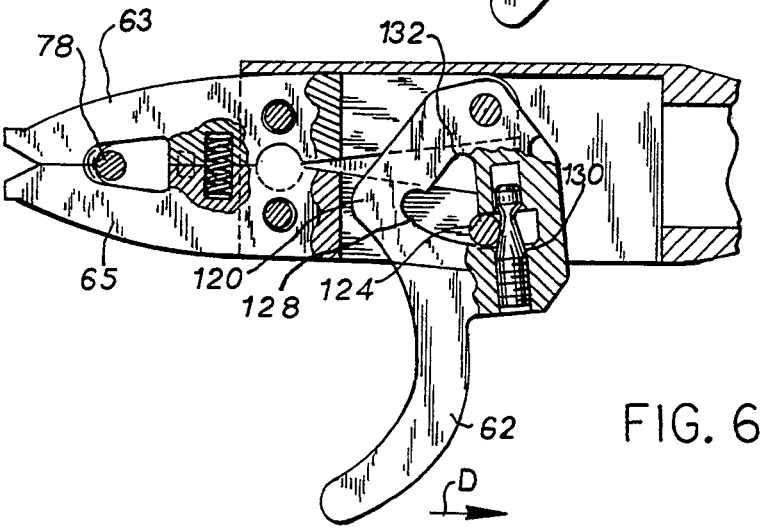
FIG. 6 is a view similar to FIG. 4, showing the release mechanism with the trigger cocked for a reverse fire motion.

As is shown in FIGS. 6 and 7, the trigger mechanism 62 of the subject invention is also adapted for use in a forward locked trigger fashion, wherein the trigger is moved rearward in the direction of the arrow D (FIG. 6) in order to release the string 78. Specifically, the release is initially open as shown in FIGS. 5 and 7. Once the string 78 is inserted between the notches 74 of the jaws 63 and 65, the release may be closed by pushing the trigger forward. This permits the guide pin 124 to ride along the rear surface 148 guide path base 132 and to the junction point 150. In order to release the jaw, the trigger 62 is moved rearwardly in the direction of arrow D, permitting the guide pin 124 to move past the corner 150 of the base into the slot and along the rear wall 148 of the slot into the base 132, for spreading the jaws apart and releasing the string.

It is often desirable to adjust the "pull" force required to operate the trigger. In the preferred embodiment, as is shown in FIGS. 4–7, the base 120 of the trigger 62 includes an elongated aperture or channel 180 extending downwardly through and intersecting the rearwardly extending outer reach 130 of the guide path. The outer end 182 of the channel 180 is tapped and adapted for receiving a threaded shaft such as the set screw 184. The set screw 184 extends through the reach 130 and into the lower or inner end 186 of the channel 180. A bearing surface 188 is provided on the inner end of the set screw 184. The portion 190 of the set screw which intersects the reach 130 of the guide path is tapered to provide a surface which intersects the reach 130 at an oblique angle. This permits the set screw to be turned and moved axially along its path in the channel 180 while adjusting the lengths of the reach 130 for providing a positive stop for the guide pin 124, as is specifically shown in FIG. 6.

By turning the screw 184 inwardly or outwardly in the channel 180, it can be seen that the positive stop for the guide 124 is adjusted along the tapered surface 190 of the set screw for adjusting the "pull" of the trigger 62. This assures that the adjustment of the reach length is provided in a direction substantially orthogonal to the primary trigger forces, providing a more accurate and more durable adjustment mechanism. Further, by utilizing the adjustment mechanism of the preferred embodiment, the screw head 192 is more readily accessed, being positioned just behind the trigger 62.

Additionally, the tapered set screw in combination with the specially profiled surface at point 150 results in an adjustment means that is in terms of incremental rotation of the screw, directly proportional to the force required to operate the trigger. It is to be readily understood that by changing the profile at point 150 or changing the taper on the adjustment screw the adjustment can be completely or partially proportional throughout the entire adjustment range. The adjustment at lower trigger pull settings if so desired, can require more adjustment input then is required at higher trigger pull settings resulting in a very precisely adjustable trigger at low trigger pull settings. The specially profiled surface at point 150 and the tapered set screw together or separately enable release adjustment in a manner not possible in any current release.

While the preferred embodiment of the subject invention includes a plurality of unique features which may be used either in combination with one another or independently with other bow string release mechanisms, it will be readily understood that the various features of the invention both independently and in combination greatly enhance the function, durability and manufacturability of a bow string release mechanism. Thus while specific features and embodiments of the invention have been described in detail herein, it will be readily understood that the invention encompasses all modifications and enhancements within the scope and spirit of the following claims.

What is claimed is:

1. A bow string release of the type having a body, a sear mounted in the body and having a string receptive notch for selectively receiving a bow string, the sear movable between a closed, string retaining position and an open, string releasing position, and a trigger mechanism associated with the sear and movable between a ready position for locking the sear in the closed, string retaining position and a fire position for opening the sear and releasing the string, the trigger mechanism comprising:

a. a trigger base pivotally mounted on the sear by a pivot, the base including a guide slot, said guide slot being generally T-shaped, having a base located adjacent to the pivot and a top section extending a length across the T-shape, the top section including at opposite ends a forward outer reach and a rearward outer reach;

b. a guide pin secured to the release and received in said guide slot controlling the pivotal movement of the trigger relative to the sear;

c. a trigger lever secured to the base and projecting outwardly from the release body for moving the guide pin in the guide slot, the guide slot being further characterized in that it permits movement of the trigger lever in both a position forward of the pivot and a position rearward of the pivot for advancing the trigger from the ready position to the fire position; and d. wherein the sear is in the open, string releasing position when the guide pin is in the base of the guide slot, the sear being movable to the closed, string retaining position by moving the trigger lever either forward, to advance the guide pin to the forward outer reach, or backward, to advance the guide pin to the rearward outer reach, and wherein the sear is opened and the string is released by moving the trigger lever either forward or backward to return the guide pin to the base of the guide slot.

2. The bow string release of claim 1, wherein the sear further comprises: a pair of opposed jaws pivotally mounted in the body and having outer ends defining a string retaining notch when the jaws are in abutting relationship with one another, the outer end of the jaws selectively movable from the abutting string retaining position to a separated release position by movement of the trigger.

3. The bow string release of claim 2, wherein the trigger base is pivotally mounted on one of said jaws and the guide pin is mounted on the other of said jaws.

4. The bow string release of claim 1, wherein the rearward outer reach is in alignment with the forward outer reach and wherein the movement of the trigger in the backward direction is limited by the rearward outer reach and the movement of the trigger lever in the forward direction is limited by the forward outer reach.

5. The bow string release of claim 4, wherein the rearward outer reach is defined by an adjustable abutment member for controlling the force required to operate the trigger lever.

6. The bow string release of claim 5, wherein the base of the trigger includes a receptacle in communication with the rearward outer reach of the guide slot and wherein the adjustable abutment member is received in said receptacle and is selectively movable relative to said guide slot.

7. The bow string release of claim 6, wherein the receptacle is tapped and the abutment member includes a threaded shaft adapted to be received in the tapped receptacle, whereby the length of the top section at the rearward outer reach is adjusted by rotating the abutment member for advancing and retracting it in the tapped receptacle.

8. The bow string release of claim 6, wherein the receptacle is substantially orthogonal to the rearward outer reach.

9. The bow string release of claim 8, wherein the abutment member includes a reach intersecting element which intersects the rearward outer reach at an angle such that axial movement of the abutment member in the receptacle alters the position of the intersecting element for altering the length of the top section at the rearward outer reach.

10. The bow string release of claim 9, wherein the receptacle comprises a tapped through hole extending from the guide slot to the outer surface of the trigger base, and wherein the abutment member comprises a threaded set-screw received in said receptacle.

11. A bow string release of the type having a body, a sear mounted in the body and having a string receptive notch for selectively receiving a bow string, the sear movable between a closed, string retaining position and an open, string releasing position, and a trigger mechanism associated with the sear and movable between a ready position for locking the sear in the closed, string retaining position and a fire position for opening the sear and releasing the string, the bow string release comprising:

a. a pair of elongated sear elements mounted in the body, each having outer end extending beyond the body and having a string retaining notch adjacent thereto and an inner end within the body, at least one of said sear elements being mounted for pivotal movement in said body, whereby the outer ends of the sear elements may be moved between an abutting, string retaining relationship and a separated, string releasing relationship;

b. a trigger associated with the sear elements adjacent the inner end and adapted for selectively engaging and locking the sear in the closed string retaining position and for unlocking and releasing the sear for releasing the bow string;

c. the outer ends of the sear elements further including outer tips which are in non-abutting relationship and forming substantially an open V when the sear is in the closed, string retaining position, a string retaining notch spaced inwardly from the spaced apart outer tips and an abutting portion between the notches and the outer ends.

12. The bow string release of claim 11, wherein both of said elongated sear elements is mounted for pivotal movement within the body.

13. A bow string release of the type having a body, a sear mounted in the body and having a string receptive notch for selectively receiving a bow string, the sear movable between a closed, string retaining position and an open, string releasing position, and a trigger mechanism associated with the sear and movable between a ready position for locking the sear in the closed, string retaining position and a fire position for opening the sear and releasing the string, the bow string release comprising:

a. a pair of elongated sear elements mounted in the body, each having outer end extending beyond the body and having a string retaining notch adjacent thereto and an inner end within the body, at least one of said sear elements being mounted for pivotal movement in said body, whereby the outer ends of the sear elements may be moved between an abutting, string retaining relationship and a separated, string releasing relationship, said outer ends including outer tips forming substantially an open V when the sear is in the closed, string retaining position;

b. a trigger associated with the sear elements adjacent the inner end and adapted for selectively engaging and locking the sear in the closed string retaining position and for unlocking and releasing the sear for releasing the bow string;

c. at least one of said sear elements being mounted for pivotal movement in said body, intermediately of said inner and outer ends, the sear elements further including a resilient cushion disposed between said sear elements adjacent said inner ends for cushioning the engagement between the sear elements when the sear is moved from the string retaining position to the string releasing position.

14. The bow string release of claim 13, wherein both of said elongated sear elements is mounted for pivotal movement within the body.

15. A bow string release of the type having a body, a sear mounted in the body and having a string receptive notch for selectively receiving a bow string, the sear movable between a closed, string retaining position and an open, string releasing position, and a trigger mechanism associated with the sear and movable between a ready position for locking the sear in the closed, string retaining position and a fire position for opening the sear and releasing the string, the bow string release comprising:

a. a pair of elongated sear elements mounted in the body, each having outer end extending beyond the body and having a string retaining notch adjacent thereto and an inner end within the body, at least one of said sear elements being mounted for pivotal movement in said body, whereby the outer ends of the sear elements may be moved between an abutting, string retaining relationship and a separated, string releasing relationship;

b. a trigger associated with the sear elements adjacent the inner end and adapted for selectively engaging and locking the sear in the closed string retaining position and for unlocking and releasing the sear for releasing the bow string;

c. at least one of said sear elements being mounted for pivotal movement in said body, intermediately of said inner and outer ends, the sear elements further including an arcuate tab positioned adjacent the pivot point of one sear element and projecting outwardly from said one sear element toward the other sear element, said other sear element including a mated receptacle for receiving said tab.

16. The bow string release of claim 15, wherein each sear element is of a predetermined thickness and thickness dimension of the tab and the receptacle is less than half the thickness of the sear elements.

17. The bow string release of claim 15, further including a second arcuate tab positioned adjacent the pivot point of one sear element and projecting outwardly from said other sear element toward said one sear element, said one sear element including a second mated receptacle for receiving said second tab.

18. The bow string release of claim 17, wherein said first tab is in axial alignment with said second receptacle and wherein said second tab is in axial alignment with said first receptacle and the thickness dimension of each of said tabs and receptacles is less than half the thickness of the sear elements.

19. The bow string release of claim 15, wherein at least one of said sear elements includes a pin projecting outwardly therefrom and toward the other of said sear elements, said pin being positioned between the pivot point and the outer end of said sear elements, and other of said sear elements including a pin receptive socket for receiving the pin when the sear is in the closed, string retaining position.

20. The bow string release of claim 19, wherein at the other of said sear elements includes a second pin projecting outwardly therefrom and toward said one said sear elements, said second pin being positioned between the pivot point and the outer end of said sear elements, and said one said sear elements including a second pin receptive socket for receiving the second pin when the sear is in the closed, string retaining position.

21. The bow string release of claim 15, wherein there is further included a biasing member in engagement with said sear elements for normally urging the sear into the open, string releasing position.

22. The bow string release of claim 21, wherein the biasing member is a compression element and is positioned between the pivot point and the outer ends of the sear elements.

23. The bow string release of claim 21, wherein the biasing member is an elongated spring and each sear element includes a recessed spring seat.

24. The bow string release of claim 15, wherein both of said elongated sear elements is mounted for pivotal movement within the body.

* * * * *